US005671715A

United States Patent [19]

Tsuzuki

[11] Patent Number: 5,671,715

[45] Date of Patent: Sep. 30, 1997

[54] FUEL INJECTION DEVICE

[75] Inventor: Yoshihiro Tsuzuki, Handa, Japan

[73] Assignee: Nipon Soken, Inc., Nishio, Japan

[21] Appl. No.: 638,154

[22] Filed: Apr. 26, 1996

[30] Foreign Application Priority Data

Apr. 27, 1995 [JP] Japan ..... 7-104152
May 25, 1995 [JP] Japan ..... 7-126566

[51] Int. Cl.[6] ..... F02M 41/00

[52] U.S. Cl. ..... 123/467; 239/96

[58] Field of Search ..... 123/446–7, 467; 239/96

[56] References Cited

U.S. PATENT DOCUMENTS

| | | | |
|---|---|---|---|
| 4,249,497 | 2/1981 | Eheim et al. | 123/447 |
| 5,012,786 | 5/1991 | Voss | 123/467 |
| 5,014,671 | 5/1991 | Taue et al. | 239/96 |
| 5,125,575 | 6/1992 | Iwanaga | 239/96 |
| 5,127,583 | 7/1992 | Taue | 239/96 |
| 5,176,120 | 1/1993 | Takahashi | 123/467 |
| 5,467,754 | 11/1995 | Beck et al. | 123/467 |
| 5,551,634 | 9/1996 | Raab et al. | 239/96 |

FOREIGN PATENT DOCUMENTS

| | | |
|---|---|---|
| 56-31656 | 1/1981 | Japan . |
| 2-191865 | 7/1990 | Japan . |

*Primary Examiner*—Thomas N. Moulis
*Attorney, Agent, or Firm*—Cushman Darby & Cushman IP Group of Pillsbury Madison & Sutro, LLP

[57] ABSTRACT

A fuel injection device includes an injection hole for injecting fuel therethrough, a needle movable between a first position to open the injection hole and a second position to close the injection hole, and a back-pressure chamber. The fuel injection device further includes a two-way solenoid valve for opening and closing a flow passage between the back-pressure chamber and a drain side so as to change a pressure in the back-pressure chamber. The needle is movable between the first and second positions depending on the pressure in the back-pressure chamber. A first flow restrictor and a second flow restrictor are provided in a flow passage, which introduces high-pressure fuel into the back-pressure chamber, so as to restrict a flow of the high-pressure fuel passing therethrough. The first and second flow restrictors may be arranged in series to each other. In this case, one of the first and second flow restrictors works as a flow restrictor to restrict the fuel flow passing therethrough only when the needle moves to the first position. The first and second flow restrictors may also be arranged in parallel with each other. In this case, one of the first and second flow restrictors is closed when the needle moves to the first position. In this fashion, the wasteful release of the high-pressure fuel toward the drain side during the fuel injection is effectively prevented while ensuring a quick response for stopping the fuel injection.

36 Claims, 9 Drawing Sheets

FUEL INJECTION DEVICE

BACKGROUND OF THE INVENTION

1. Field of the Invention

The present invention relates to a fuel injection device for an internal combustion engine.

2. Description of the Prior Art

Japanese First (unexamined) Patent Publication No. 2-191865 discloses an accumulator fuel injection device, wherein a high-pressure fuel in an accumulator piping (common rail) is injected into a combustion chamber of an engine, such as a diesel engine, by controlling an open/close operation of a fuel injection valve using a three-way solenoid valve as a control valve. FIG. 14 shows the whole structure thereof. In the figure, a fuel injection valve 131 includes a nozzle 132 having fuel injection holes 139, and a needle 135 for opening and closing the fuel injection holes 139. The needle 135 is constantly urged by a needle spring 136 in a direction to close the fuel injection holes 139. On the other hand, a step **135*b* of the needle 135 is urged in a direction to open the fuel injection holes 139 due to a pressure of the high-pressure fuel in an oil sump 140**.

The needle 135 is coupled to a piston 137 via a piston rod 138 extending upward. Depending on a pressure of the fuel introduced into a working chamber **133*b* formed at an upper portion of a cylinder 133*a* which slidably receives therein the piston 137 within a holder 133, the needle 135 moves axially along with the piston 137 so as to open or close the fuel injection holes 139. The fuel pressure in the working chamber 133*b* is controlled by a three-way solenoid valve 160 via an inlet/outlet port 159 for the high-pressure fuel so as to control movement of the piston 137**.

The fuel in a fuel tank 144 is pressurized by a high-pressure pump 142 to be stored in an accumulator piping 143. A portion of the high-pressure fuel is supplied to a supply port 161 of the three-way solenoid valve 160, while a discharge port 162 thereof is constantly connected to the fuel tank 144 which is held at a low pressure. Thus, depending on whether a solenoid coil 147 is energized or not, the three-way solenoid valve 160 selectively applies the high pressure at the supply port 161 and the low pressure at the discharge portion 162 to a connection port 150, which is then introduced into the working chamber **133*b* via the high-pressure fuel inlet/outlet port 159 to change the pressure in the working chamber 133*b* so as to move the piston 137**.

In FIG. 14, numeral 156 denotes a plate valve which is formed with an orifice 157. The plate valve 156 is biased by a spring 158 toward the high-pressure fuel inlet/outlet port 159. Depending on a direction of the flow of the fuel passing through the inlet/outlet port 159, the plate valve 156 is arranged to provide the flow restricting effects of different magnitudes relative to the fuel passing through the inlet/outlet port 159. In FIG. 14, numeral 155 denotes a pump pressure control device for controlling a discharge rate of the high-pressure pump 142 and thus a discharge pressure thereof in response to a command from an electronic control unit (ECU). A arrow extending from the accumulator piping 143 represents a flow passage of the high-pressure fuel for a fuel injection valve 131 of another engine cylinder.

When the solenoid coil 147 of the three-way solenoid valve 160 is energized under the command of the ECU 163 including a drive circuit, the connection port 150 communicates with the discharge port 162 so that the working chamber **133*b* becomes low in pressure. Accordingly, due to an upward force applied to the step 135*b* of the needle 135 from the high-pressure fuel in the oil sump 140, the needle 135 and the piston 137 are raised upward as one unit to open the fuel injection holes 139 so that the fuel injection is started with a slight time delay from the energization of the solenoid coil 147**.

On the other hand, when the solenoid coil 147 is deenergized under the command of the ECU 163, the connection port 150 communicates with the supply port 161 so that the high-pressure fuel in the accumulator 143 is fed to the working chamber **133*b* via the three-way solenoid valve 160 and the inlet/outlet port 159. Thus, the working chamber 133*b* becomes high in pressure. The sum of the force caused by the high-pressure fuel in the working chamber 133*b* and the biasing force of the needle spring 136 overcomes the upward force caused by the pressure in the oil sump 140 so as to move downward the piston 137 and the needle 135. Thus, the fuel injection holes 139** are closed to stop the fuel injection.

In the three-way solenoid valve 160 used in the foregoing conventional fuel injection valve, when the connection port 150 is switched between the supply port 161 and the discharge port 162, the supply port 161 and the discharge port 162 structurally communicate with each other for a very short time. This causes the high-pressure fuel in the accumulator piping 143 to leak into the low-pressure fuel tank 144 so that the pressure in the accumulator piping 143 is lowered. By using this mechanism, the pressure of the high-pressure fuel in the accumulator piping 143 can be quickly lowered upon rapid deceleration of the engine so as to achieve the improved control of the fuel injection amount.

Specifically, when the fuel injection is started, the connection port 150 of the three-way solenoid valve 160 is connected to the discharge port 162 so as to release the high-pressure fuel in the working chamber **133*b* into the fuel tank 144 via the inlet/outlet port 159. However, since the plate valve 156 with the orifice 157 is provided at the inlet/outlet port 159, the high-pressure fuel passes through the orifice 157. Thus, a short time delay (for example, 0.4 ms) is caused from a time point where the three-way solenoid valve 160 is switched, to a time point where the piston 137 and the needle 135 are raised to open the injection holes 139. Accordingly, if the switching operations, each shorter than the time delay, such as 0.3 ms, are performed in given times for the three-way solenoid valve 160, the pressure reduction in the accumulator piping 143 can be achieved without causing the fuel injection via the injection holes 139**. In this fashion, by performing this non-injecting operation of the three-way solenoid valve, the high-pressure fuel in the accumulator piping can be effectively lowered in pressure.

On the other hand, in recent years, an extremely high injection pressure, such as 200 MPa, has been required for a fuel injection device for an internal combustion engine for improving the exhaust emission. Since, in general, a sliding portion in the fuel passage is liable to cause fuel leakage, it is preferable to achieve a structure with less or no sliding portions. For this reason, it is preferable to use a two-way solenoid valve, which is simple in structure and low in cost, rather than the three-way solenoid valve having more sliding portions than the two-way solenoid valve and being complicated in structure and high in cost.

FIG. 15 shows one example of a fuel injection device using a two-way solenoid valve 198 as a control valve of a fuel injection valve 171. A high-pressure fuel passage 182 communicates with a high-pressure pump (not shown) and forms an accumulator piping 193 as an enlarged space of a fuel passage 185. The accumulator piping 193 communicates with an oil sump 180 via a high-pressure fuel passage 181. The accumulator piping 193 communicates with a space 189 representing a drain passage leading to a fuel tank (not shown), via a spring seat 190 opened or closed by a valve element 188 of the two-way solenoid valve 198 and via an orifice 196 provided at the upstream side of the spring seat 190 and having a very small flow-passage sectional area. A fuel passage between the spring seat 190 and the orifice 196 works as a back-pressure chamber 197 for applying a pressure onto an upper end surface of a needle 175.

In FIG. 15, numeral 187 denotes a solenoid coil of the two-way solenoid valve 198 controlled by an electronic control unit (not shown), numeral 191 denotes a valve spring for biasing the valve element 188 toward the valve seat 190, numeral 172 denotes a nozzle of the fuel injection valve 171, numeral 179 denotes fuel injection holes formed in the nozzle 172, and numeral **175*b* denotes a step of the needle 175**.

When the solenoid coil 187 is energized under the command of the electronic control unit, the valve element 188 opens the valve seat 190 against the biasing force of the valve spring 191. Since the pressure of the high-pressure fuel in the back-pressure chamber 197 is lowered, the needle 175 moves upward due to a force caused by the pressure of the high-pressure fuel in the oil sump 180 exerted on the step **175*b* of the needle 175. Thus, the injection holes 179 are opened so that the high-pressure fuel is injected into a combustion chamber of a corresponding engine cylinder. At this time, an amount of the high-pressure fuel leaking from the accumulator piping 193 to the drain passage 189 is limited by the orifice 196**.

On the other hand, when stopping the fuel injection, the solenoid coil 187 is deenergized so as to cause the valve element 188 to be seated on the valve seat 190 by means of the valve spring 191. As a result, the high-pressure fuel flows from the accumulator piping 193 into the back-pressure chamber 197 via the orifice 196 so that the pressure in the back-pressure chamber 197 is increased. Thus, the needle 175 is pushed down to close the injection holes 179 so that the fuel injection is stopped. As appreciated, the office 196 in this example achieves an operation corresponding to the operation of the foregoing three-way solenoid valve 160 for introducing the high-pressure fuel from the accumulator piping 143 into the working chamber **138*b*. Accordingly, if a flow-passage sectional diameter of the orifice 196** is small, the control response for stopping the fuel injection is delayed.

On the other hand, when the foregoing recent extremely high-pressure fuel is used, the flow rate of the fuel passing the orifice is increased correspondingly. Thus, if the flow-passage sectional area of the orifice 196 is set larger for improving the control response at the time of stopping the fuel injection, an amount of the fuel leaking to the drain side via the operated two-way solenoid valve 198 increases so that the pressure of the high-pressure fuel in the accumulator piping 193 is abnormally lowered. This also wastes the high-pressure fuel and thus may require a high-pressure pump of a larger capacity, which is high in cost. Further, in an extreme case, even when the valve element 188 opens the valve seat 190, it is possible that the pressure in the back-pressure chamber 197 is not sufficiently lowered, and thus, the needle 175 can not be lifted to render the fuel injection impossible.

As appreciated from the foregoing description, in the fuel injection device using the two-way solenoid valve 198, the flow-passage sectional area of the orifice 196 may be set as small as possible so as to ensure lifting of the needle 175 and suppress wasteful leakage of the high-pressure fuel to the drain side. In this case, however, lowering of the control response at the time of stopping the fuel injection can not be avoided. Further, even if the foregoing so-called "non-injecting operation" is performed by opening the two-way solenoid valve 198 for a given short time, so as to release the high-pressure fuel in the accumulator piping 193 to the drain side without lifting the needle 175, that is, without causing the fuel injection, the flow-passage sectional area of the orifice 196 is so small that the sufficient pressure reduction can not be achieved.

SUMMARY OF THE INVENTION

Therefore, it is an object of the present invention to provide an improved fuel injection device for an internal combustion engine.

According to one aspect of the present invention, a fuel injection device comprises an injection hole for injecting fuel therethrough; a needle movable between a first position to open the injection hole and a second position to close the injection hole; a back-pressure chamber for receiving high-pressure fuel therein and applying a pressure of the high-pressure fuel to an upper end side of the needle for urging the needle toward the second position; a two-way valve for opening and closing a flow passage between the back-pressure chamber and a drain side to change the pressure in the back-pressure chamber so as to move the needle between the first and second positions for controlling injection of the fuel through the injection hole; and flow restricting means, provided in a flow passage for introducing the high-pressure fuel into the back-pressure chamber, for restricting a flow of the high-pressure fuel passing therethrough, the flow restricting means reducing a flow-passage area thereof when the needle moves to the first position.

It may be arranged that an accumulator piping is provided for storing the high-pressure fuel therein, a high-pressure pump is provided for pressurizing fuel to be the high-pressure fuel for feeding to the accumulator piping, and a pump pressure control device is provided for controlling the high-pressure pump so as to control a pressure of the high-pressure fuel in the accumulator piping.

It may be arranged that an oil sump is formed around a stepped portion of the needle for receiving the high-pressure fuel therein so as to urge the needle toward the first position, and a needle spring is disposed for biasing the needle toward the second position.

It may be arranged that the flow restricting means comprises a first flow restrictor and a second flow restrictor which are arranged in series to each other.

It may be arranged that the pressure in the back-pressure chamber is exerted on a command piston coupled to the upper end side of the needle.

It may be arranged that the first flow restrictor is formed around an upper portion of the command piston.

It may be arranged that the second flow restrictor comprises a groove formed on an upper end surface of the command piston and a surface confronting the upper end surface of the command piston and is established to restrict the flow of the high-pressure fuel passing between the groove and the confronting surface when the needle moves to the first position to cause the upper end surface of the command piston to abut the confronting surface.

It may be arranged that the second flow restrictor comprises a groove formed on a surface confronting an upper end surface of the command piston and the upper end surface of the command piston and is established to restrict the flow of the high-pressure fuel passing between the groove and the upper end surface of the command piston when the needle moves to the first position to cause the upper end surface of the command piston to abut the confronting surface.

It may be arranged that the flow restricting means comprises a first flow restrictor and a second flow restrictor which are arranged in parallel with each other.

It may be arranged that the pressure in the back-pressure chamber is exerted on a command piston coupled to the upper end side of the needle.

It may be arranged that the first flow restrictor is formed by a flow passage surrounding an upper portion of the command piston.

It may be arranged that the second flow restrictor comprises a through hole formed in the command piston, and that the flow passage forming the first flow restrictor is blocked when the needle moves to the first position to cause the command piston to abut a surface confronting the command piston.

It may be arranged that the two-way valve comprises a valve element formed therein with a cylinder communicating with the back-pressure chamber and a balance rod is inserted into the cylinder so that, when the pressure in the back-pressure chamber is applied to the balance rod via the cylinder, the valve element is urged toward the back-pressure chamber due to a reaction force.

It may be arranged that the first flow restrictor is formed between an upper portion of the needle and an inner wall of a nozzle in which the needle is movably received.

It may be arranged that the second flow restrictor comprises a groove formed on a lower end surface of a distance piece mounted at an upper end of the nozzle and an upper surface of the needle and is established to restrict the flow of the high-pressure fuel passing between the groove and the upper surface of the needle when the needle moves to the first position to cause the upper surface of the needle to abut the lower end surface of the distance piece.

It may be arranged that the first flow restrictor is formed by a flow passage between an upper portion of the needle and an inner wall of a nozzle in which the needle is movably received.

It may be arranged that the second flow restrictor comprises a through hole formed in the needle, and that the flow passage forming the first flow restrictor is blocked when the needle moves to the first position to abut a lower end surface of a distance piece mounted at an upper end of the nozzle.

It may be arranged that the two-way valve is in the form of a solenoid valve.

BRIEF DESCRIPTION OF THE DRAWINGS

The present invention will be understood more fully from the detailed description given hereinbelow, taken in conjunction with the accompanying drawings.

In the drawings.

DESCRIPTION OF THE PREFERRED EMBODIMENT

Now, preferred embodiments of the present invention will be described hereinbelow with reference to the accompanying drawings. The same or like components are represented by the same reference signs or symbols throughout the figures showing the preferred embodiments of the present invention, so as to avoid redundant explanation thereof for brevity of the disclosure.

The first preferred embodiment of the present invention will be described hereinbelow with reference to FIGS. 1 to 6.

Figure 1:
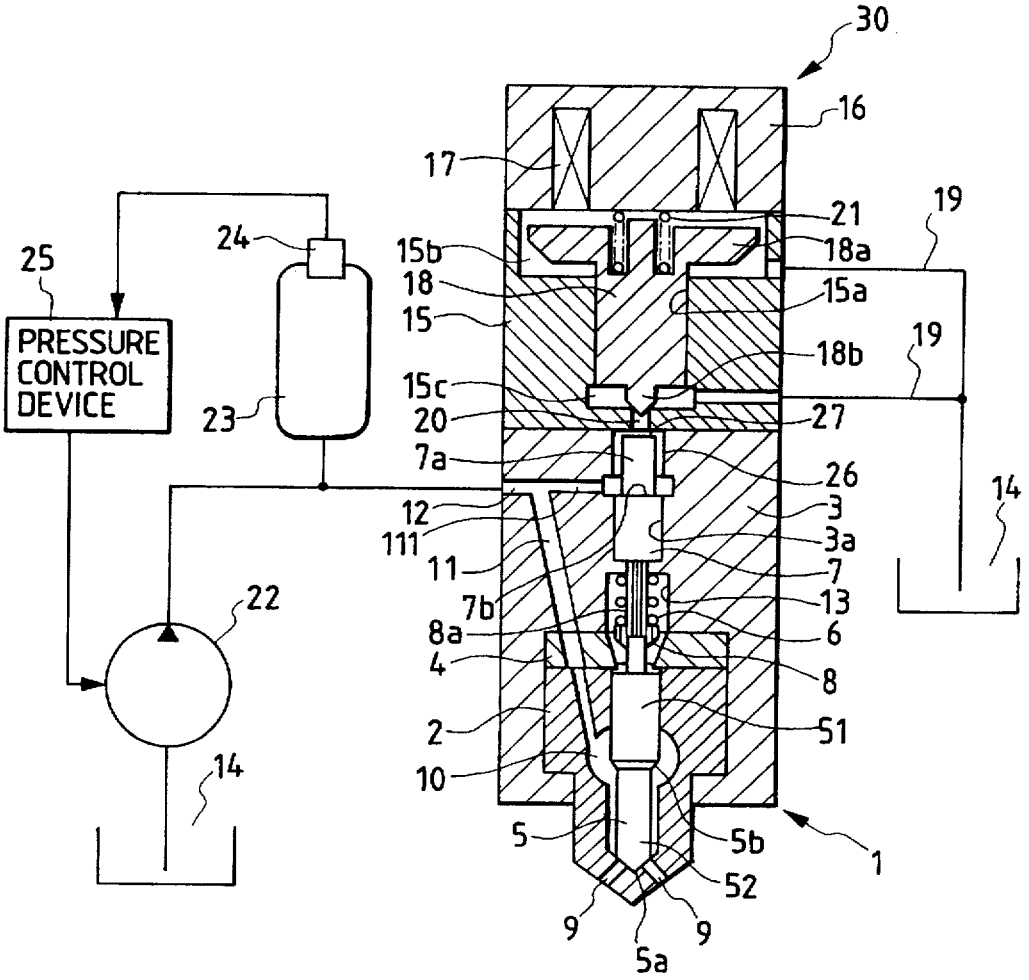
FIG. 1 is a sectional view showing the whole structure of an accumulator fuel injection device for an internal combustion engine according to a first preferred embodiment of the present invention.

In FIG. 1, a fuel injection valve 1 includes a nozzle 2 at its lower end, a holder 3 supporting the nozzle 2, a distance piece 4 having a center opening and interposed between the nozzle 2 and the holder 3, a valve needle 5 having a larger-diameter portion 51 and a smaller-diameter portion 52 and slidably received in the nozzle 2 with a clearance of about 2 to 3 μm between the larger-diameter portion 51 and the inner wall of the nozzle 2, and a needle spring 6 constantly urging the needle 5 downward. The fuel injection valve 1 further includes a command piston 7 having a stepped shape with a larger-diameter portion and a smaller-diameter portion 7a with a step 7b formed therebetween. The command piston 7 is slidably received in a cylinder 3a formed in the holder 3 with a clearance of about 2 to 3 μm relative to the wall of the cylinder 3a at its larger-diameter portion and with a clearance of some tens of micrometers relative to the wall of the cylinder 3a at its smaller-diameter portion 7a, which will be described later in detail. The fuel injection valve 1 further includes a spring holder 8 interposed between the needle 5 and the command piston 7 along with the needle spring 6, and a two-way solenoid valve of a simple structure generally designated by numeral 30 and mounted on the holder 3.

As appreciated, the fuel injection valve 1 is provided for each engine cylinder of a multi-cylinder internal combustion engine.

The nozzle 2 is formed at its lower end with injection holes 9. The injection holes 9 are opened or closed by means of a conical tip 5a of the needle 5 when the needle 5 moves upward or downward. The needle 5 is formed with a downward-orienting step 5b between the larger-diameter portion 51 and the smaller-diameter portion 52. Around the downward-orienting step 5b, an oil sump 10 in the form of a space is formed within the nozzle 2. The oil sump 10 communicates at its lower side with an annular passage formed between the smaller-diameter portion 52 of the needle 5 and the inner wall of the nozzle 2 so that a high-pressure fuel from the oil sump 10 is injected into a combustion chamber of the corresponding engine cylinder via the injection holes 9 when the conical tip 5a of the needle 5 opens the injection holes 9. On the other hand, the oil sump 10 communicates at its upper side with a high-pressure fuel introducing inlet port 12 via a high-pressure fuel passage 11 in the form of passages continuously formed in the nozzle 2, the distance piece 4 and the holder 3.

The needle spring 6 is disposed in a compressed fashion in a spring chamber 13 which extends through the distance piece 4 into the holder 3. The upper end of the needle spring 6 is received on the holder 3 while the lower end of the needle spring 6 is received on a stepped shoulder of the spring holder 8 engaging the upper end of the needle 5, so as to urge the needle 5 toward the injection holes 9, that is, in a direction to close the injection holes 9. A shaft portion 8a of the spring holder 8 extends upward through the center of the needle spring 6 so as to be engageable with a lower end surface of the command piston 7. In this preferred embodiment, the spring chamber 13 constantly communicates, via a passage (not shown), with a drain side, that is, a fuel tank 14 which is held substantially at an atmospheric pressure.

When the fuel injection device is not in operation, since no hydraulic force is applied for moving downward the command piston 7 while the needle spring 6 is extended to move downward the needle 5 so as to close the injection holes 9, the upper end of the shaft portion 8a of the spring holder 8 and the lower end of the command piston 7 may be separated from each other. On the other hand, when the device is in operation where a hydraulic force is applied for moving downward the command piston 7, the upper end of the shaft portion 8a of the spring holder 8 and the lower end of the command piston 7 are in abutment with each other so that the needle 5 and the command spring 7 move as one unit via the spring holder 8.

The two-way solenoid valve 30 includes a valve body 15 coupled to the upper end of the holder 3, and a solenoid portion 16 coupled to the upper end of the valve body 15. In the solenoid potion 16 is disposed a solenoid coil 17 which is controlled to be energized or deenergized by means of a drive circuit which is operated in response to a command from an electronic control unit (not shown). The valve body 15 is formed therein with a valve cylinder 15a in which a piston-like valve element 18 is slidably received with a clearance of about 2 to 3 μm relative to the wall of the valve cylinder 15a. The valve element 18 has an enlarged disk portion 18a located in a working chamber 15b formed in the valve body 15 and confronting the solenoid coil 17. At least the disk portion 18a of the valve element 18 is made of a ferromagnetic material. The working chamber 15b constantly communicates with the fuel tank 14 via a drain pipe 19.

A lower portion of the valve cylinder 15a forms a drain chamber 15c which also constantly communicates with the fuel tank 14 via the drain pipe 19 so as to be held substantially at an atmospheric pressure. The valve element 18 of the solenoid valve 30 is formed at its lower end with a conical valve needle 18b. The valve needle 18b is arranged to open or close a control port 20, from above, which is formed in the valve body 15. The control port 20 is in the form of a hole and works as a small back-pressure chamber for the command piston 7 which moves together with the needle 5. The upper edge of the control port 20 works as a spring seat for the valve needle 18b. The valve element 18 is constantly urged by a valve spring 21 in a direction to close the control port 20 with its valve needle 18b. When the solenoid 17 is energized so that a magnetic attraction force applied to the disk portion 18a of the valve element 18 overcomes a biasing force of the valve spring 21, the control port 20 is opened so as to communicate with the drain chamber 15c.

In FIG. 1, numeral 22 denotes a high-pressure pump which pumps up the fuel from the fuel tank 14 and pressurizes it to a given high pressure for feeding to an accumulator piping 23. The accumulator piping 23 is also called a common raft, which is a common fuel piping with a high pressure-proof property and of a relatively large volume for temporarily storing the high-pressure fuel pressurized by the high-pressure pump 22 and feeding the high-pressure fuel to all or some of the fuel injection valves 1 via the corresponding inlet ports 12. A pressure of the high-pressure fuel in the accumulator piping 23 (actual injection pressure) is detected by a pressure sensor 24 attached thereto so as to be inputted to a pump pressure control device 25. The pump pressure control device 25 controls an operation of the high-pressure pump 22 so as to render an actual injection pressure equal to a target injection pressure required by the engine.

Figure 2:
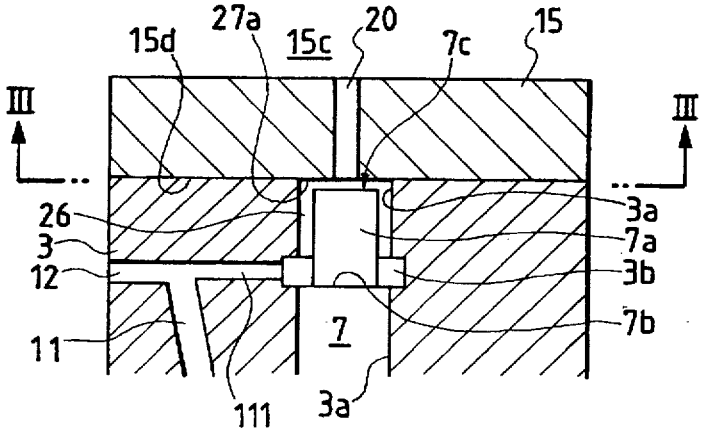
FIG. 2 is an enlarged sectional view of a main portion of a fuel injection valve shown in FIG. 1, wherein fuel injection is not performed.
Figure 4:
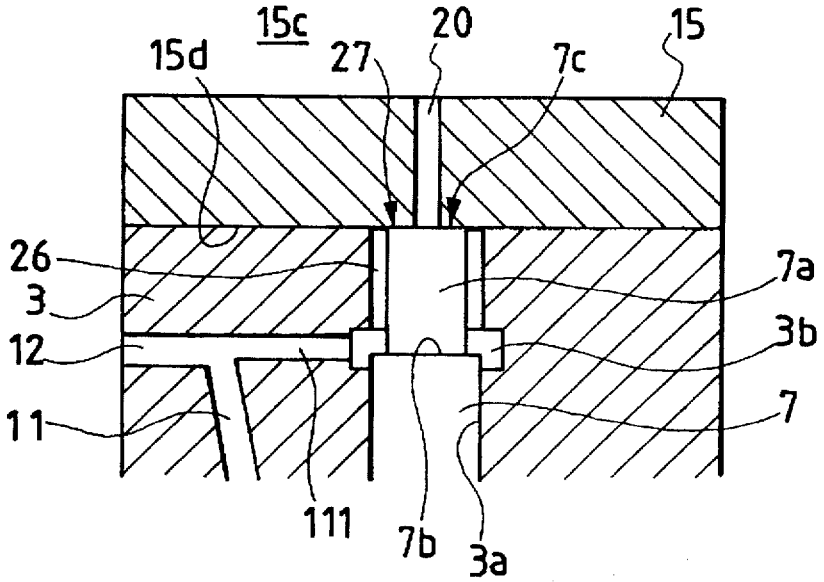
FIG. 4 is an enlarged sectional view of the main portion shown in FIG. 2, wherein fuel injection is performed.

As shown in FIGS. 2 and 4 on an enlarged scale and as described before, the command piston 7 has the larger-diameter portion and the smaller-diameter portion 7a. The clearance between the larger-diameter portion and the wall of the cylinder 3a is set to be about 2 to 3 μm, while the clearance between the smaller-diameter portion 7a and the wall of the cylinder 3a is set to be some tens of micrometers. This larger clearance between the smaller-diameter portion 7a and the wall of the cylinder 3a forms a first flow restrictor 26. The cylinder 3a is formed with an increased-diameter portion 3b which constantly communicates with the high-pressure fuel inlet port 12 by means of a high-pressure fuel passage 111 branching from the high-pressure fuel passage 11. Since the step 7b formed between the smaller-diameter portion 7a and the lager-diameter portion is arranged not to move outside the increased-diameter portion 3*b* even when the command piston 7 moves upward or downward, the high-pressure fuel supplied via the inlet port 12 is constantly introduced into the first flow restrictor 26.

Figure 3:
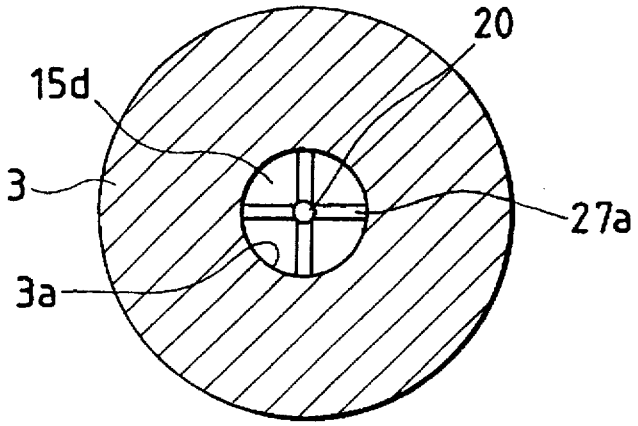
FIG. 3 is a sectional view taken along line III—III in FIG. 2.

Further, in this preferred embodiment, a second flow restrictor 27 is formed when the command piston 7 moves upward to cause its upper end surface 7*c* to abut a lower end surface 15*d* of the valve body 15. A flow-passage sectional area allowed by the second flow restrictor 27 is set smaller than that allowed by the first flow restrictor 26. As shown in FIGS. 3 and 4, the second flow restrictor 27 is constituted by thin and shallow grooves 27*a* formed on the lower end surface 15*d* of the valve body 15 and the upper end surface 7*c* of the command piston 7. The grooves 27*a* are arranged in a cross shape corresponding to arbitrary two diameters of the cylinder 3*a* orthogonal to each other. The cross-shaped grooves 27*a* may be formed on the upper end surface 7*c* of the command piston 7 rather than on the lower end surface 15*d* of the valve body 15. In this case, the second flow restrictor 27 is constituted by the cross-shaped grooves 27*a* formed on the upper end surface 7*c* of the command piston 7 and the lower end surface 15*d* of the valve body 15. In either case, in this preferred embodiment, the first and second restrictors 26 and 27 are provided in series between the increased-diameter portion 3*b* and the control port 20 when the upper end surface 7*c* of the command piston 7 abuts the lower end surface 15*d* of the valve body 15, that is, when the needle 5 is fully lifted to its uppermost position.

Now, an operation of the fuel injection valve 1 according to the first preferred embodiment will be described hereinbelow.

When the high-pressure pump 22 is operated to increase in pressure the fuel in the accumulator piping 23, the high-pressure fuel is fed to the inlet port 12 of the fuel injection pump 1 provided for each engine cylinder. Then, a portion of the high-pressure fuel is introduced via the high-pressure fuel passage 11 to the oil sump 10 and further to the neighborhood of the injection holes 9 closed by the conical tip 5*a* of the needle 5. Simultaneously, the other portion of the high-pressure fuel is also fed to the control port 20 via the increased-diameter portion 3*b* of the cylinder 3*a*, the first flow restrictor 26 and the space between the upper end surface 7*c* of the command piston 7 and the lower end surface 15*d*, formed with the cross-shaped grooves 27*a*, of the valve body 15.

When the solenoid coil 17 of the control solenoid valve 30 is deenergized, the valve element 18 is pressed downward by the valve spring 21 so that the valve needle 18*b* closes the control port 20. In this state, as shown in FIG. 2, the high fuel pressure is exerted on the upper end surface 7*c* of the command piston 7 so as to press downward the command piston 7. Since the sum of this downward force and a biasing force of the needle spring 6 is set greater than an upward force caused by the high fuel pressure exerted on the step 5*b* of the needle 5 in the oil sump 10, the command piston 7, the spring holder 8 and the needle 5 are pressed downward as one unit so as to cause the conical tip 5*a* of the needle 5 to close the injection holes 9. Thus, the fuel injection from the fuel injection valve 1 is not performed.

On the other hand, when the solenoid coil 17 is energized by the drive circuit in response to the command from the electronic control unit, the disk portion 18*a* of the valve element 18 is attracted upward against the biasing force of the valve spring 21 so that the valve needle 18*b* opens the control port 20. Accordingly, the high fuel pressure exerted on the upper end surface 7*c* of the command piston 7 is released to the fuel tank 14 via the drain chamber 15*c* and the drain pipe 19. Thus, the pressure in the control port 20 working as a back-pressure chamber is lowered so that the downward force applied to the needle 5 is substantially caused only by the biasing force of the needle spring 6. Since the upward force caused by the high-pressure fuel applied to the step 5*b* of the needle 5 in the oil sump 10 is set greater than the biasing force of the needle spring 6, the needle 5 and thus the command piston 7 move upward as shown in FIG. 4. As a result, the conical tip 5*a* of the needle 5 opens the injection holes 9 so that the high-pressure fuel is injected into the combustion chamber of the corresponding engine cylinder via the injection holes 9.

As appreciated from the foregoing description, when the upper end surface 7*c* of the command piston 7 is separated from the lower end surface 15*d* of the valve body 15 as shown in FIG. 2, the second flow restrictor 27 is not established so that no substantial flow restricting effect is provided therethrough. Thus, only the first flow restrictor 26 having a relatively large flow-passage sectional area is effective from the inlet port 12 to the control port 20. Accordingly, in this state, a large flow rate of the high-pressure fuel can be achieved from the inlet port 12 to the control port 20. Specifically, when the valve needle 18*b* of the valve element 18 opens the control port 20 to start the fuel injection, or when the valve needle 18*b* closes the control port 20 to stop the fuel injection, the second flow restrictor 27 becomes substantially ineffective and thus only the first flow restrictor 26 is effective so that the large flow rate of the high-pressure fuel is allowed. This ensures the high valve-opening and valve-closing response characteristics, and thus the high injection-starting and injection-stopping response characteristics. As appreciated, since the formation of the second flow restrictor 26 is substantially released even when the upper end surface 7*c* of the command piston 7 is slightly separated from the lower end surface 15*d* of the valve body 15, the high valve-closing response characteristic and thus the high injection-stopping response characteristic are also ensured as noted above.

On the other hand, during the fuel injection, the upper end surface 7*c* of the command piston 7 is held abutting the lower end surface 15*d* of the valve body 15 as shown in FIG. 4. In this state, the second flow restrictor 27 is established to restrict the fuel flow passing therethrough. Thus, even if the first flow restrictor 26 provides no substantial resistance to the fuel flow passing through, since the second flow restrictor 27 having a smaller flow-passage sectional area shows the large flow resistance, an amount of the high-pressure fuel released into the fuel tank 14 via the control port 20 during the fuel injection is suppressed to be very small. Accordingly, the lowering of the pressure of the high-pressure fuel in the accumulator piping 23 due to the wasteful release of the high-pressure fuel into the fuel tank 14 during the fuel injection is effectively prevented.

As described above, the second flow restrictor 27 substantially loses its flow restricting function when the fuel pressure in the control port 20, working as a back-pressure chamber for the command piston 7, increases even slightly. Accordingly, the fuel release is facilitated while the fuel injection is not performed. Thus, the so-called "non-injecting operation" of the solenoid valve 30 can be effectively performed to reduce the pressure of the high-pressure fuel in the accumulator piping 23 by opening the solenoid valve 30 given times each for a given short time during the rapid deceleration of the engine. On the other hand, only during the fuel injection where the upper end surface 7*c* of the command piston 7 is held abutting the lower end surface 15*d* of the valve body 15, the second flow restrictor 27 is formed to render the fuel release difficult.

According to this preferred embodiment, the fuel injection valve 1 having the foregoing convenient operation characteristics can be achieved by performing the open/close operation of the two-way solenoid valve 30 which is simple in structure and low in price.

Figure 5:
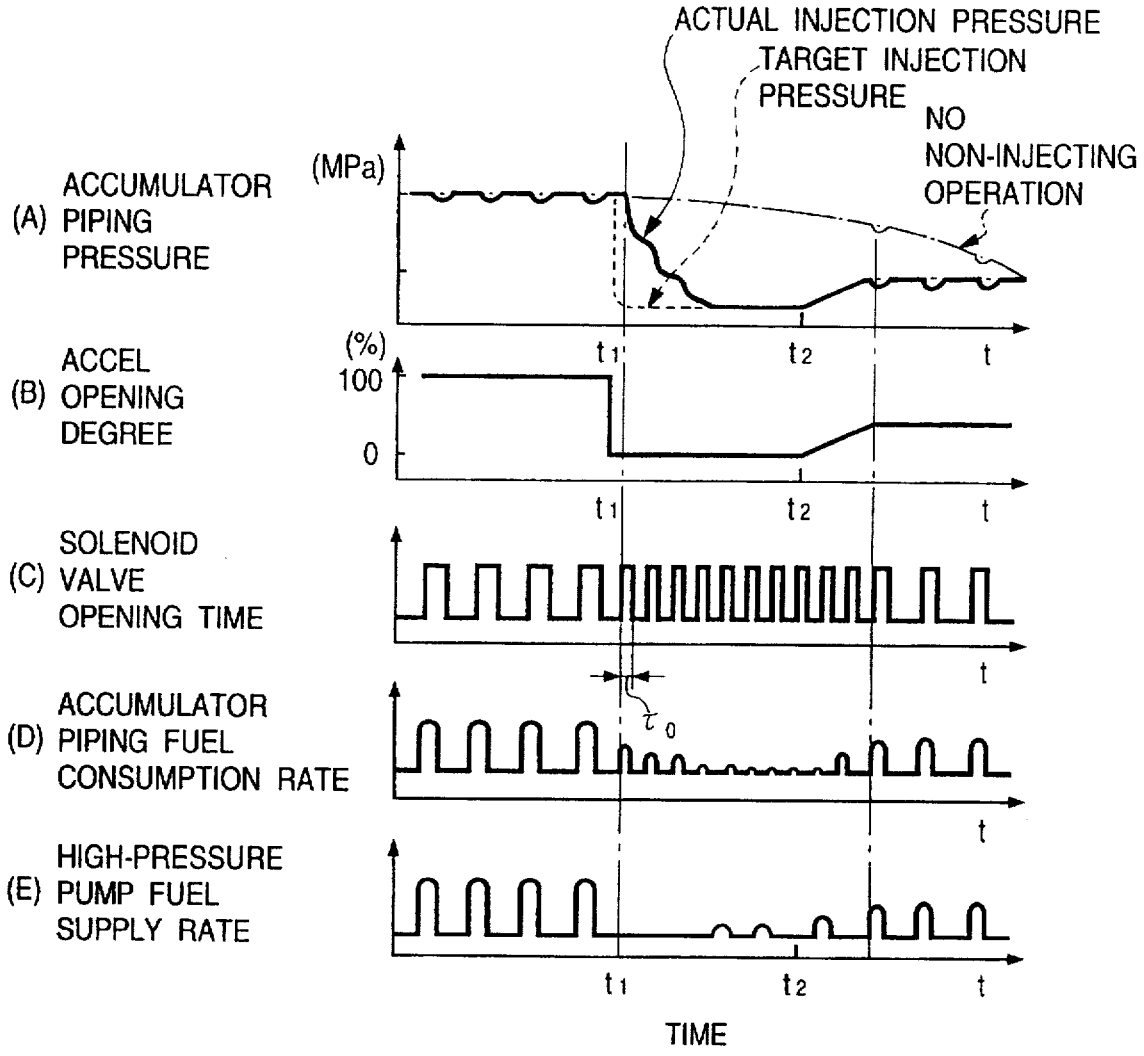
FIG. 5 is a time chart for explaining an operation of the fuel injection device shown in FIG. 1.
Figure 6:
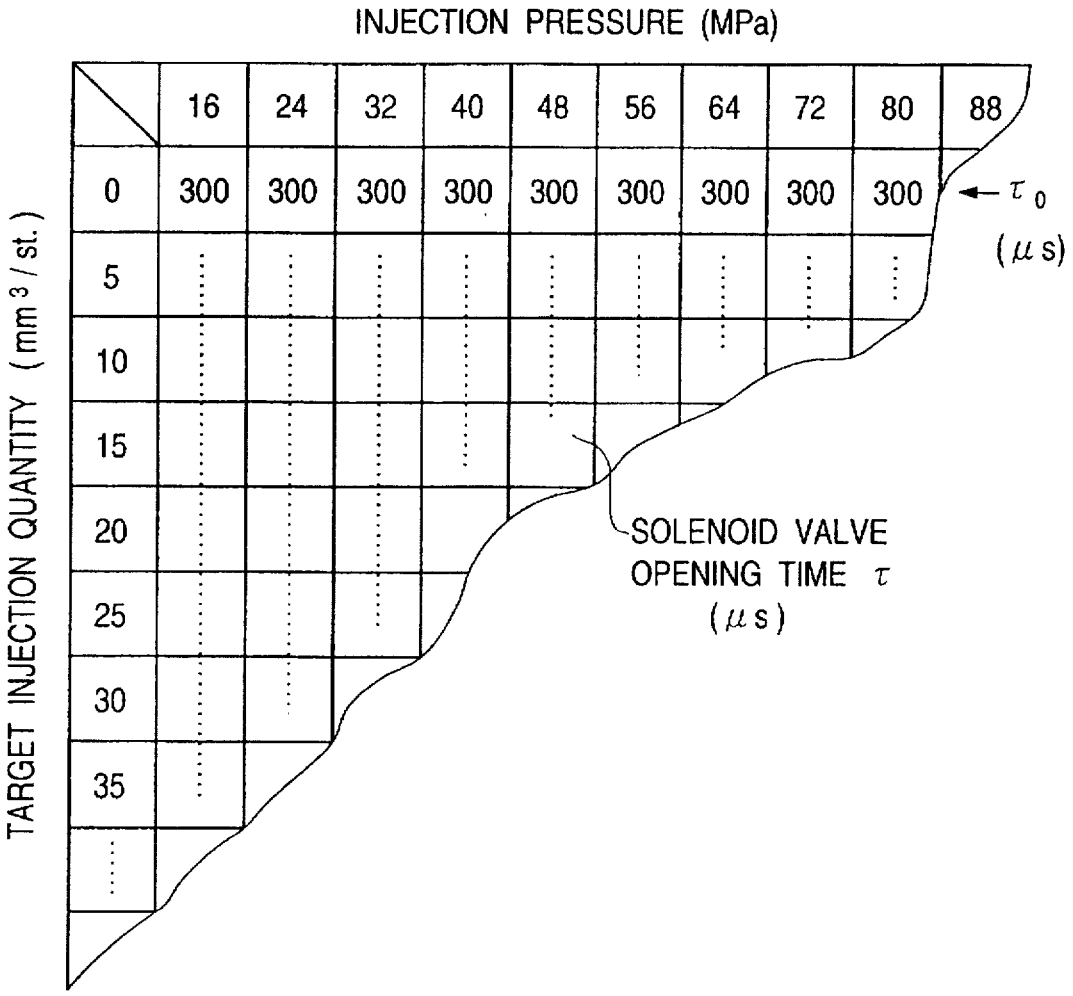
FIG. 6 is a target-injection-quantity versus injection-pressure map according to the first preferred embodiment.

FIG. 5 is a time chart for explaining an operation of the fuel injection device shown in FIG. 1, wherein the actual injection pressure, that is, the pressure of the high-pressure fuel in the accumulator piping 23, is reduced in response to a rapid change in accel opening degree (rapid deceleration) as shown at (A) and (B) in FIG. 5. In this preferred embodiment, as shown in a target-injection-quantity versus injection-pressure map of FIG. 6, even when an accel opening degree is 0%, that is, a target injection quantity is 0, the electronic control unit outputs a drive signal, as shown at (C) in FIG. 5, to the solenoid valve 30 for controlling the solenoid valve 30 to open with a solenoid valve opening time $\tau_0$, which is uniformly set to 300 μs in this preferred embodiment.

As described above, in this preferred embodiment, even when the accel opening degree is 0, the solenoid valve opening time $\tau_0$ is not set to 0, but to a value which is so short that the command piston 7 does not actually start to be raised, that is, the needle 5 does not actually start to be lifted. With this arrangement, the so-called "non-injecting operation" of the solenoid valve 30 is achieved without largely changing the program in the electronic control unit, so as to quickly reduce the actual injection pressure in response to the change in engine operating condition.

On the other hand, as shown by the alternate long and short dash line at (A) in FIG. 5, if the non-injecting operation is not performed, the pressure reducing response is very poor so that the actual injection pressure can not follow the target injection pressure even at the time of re-acceleration after time $t_2$. Thus, deterioration may be caused relative to the noise, the exhaust emission, the driveability or the like so that the engine performance may be lowered.

In this preferred embodiment, the operation of the high-pressure pump 22 is also controlled by means of the pump pressure control device 25, a fuel consumption rate of the accumulator piping 23 changes as shown at (D) in FIG. 5, and a fuel supply rate of the high-pressure pump 22 changes as shown at (E) in FIG. 5.

In order to further improve the followability of the actual injection pressure relative to the target injection pressure, the solenoid valve 30, which is normally operated synchronously with the engine rotation, may be operated asynchronously at high frequency from time $t_1$ to a time point where the actual injection pressure reaches the target injection pressure, so as to enhance the effect of the non-injecting operation. Further, by arranging that such high-frequency operations are performed simultaneously among the fuel injection valves, the effect is further enhanced.

Now, the second preferred embodiment of the present invention will be described hereinbelow with reference to FIGS. 7 and 8. As appreciated, FIGS. 7 and 8 correspond to FIGS. 2 and 4, respectively.

In the second preferred embodiment, as in the foregoing first preferred embodiment, the first flow restrictor 26 is formed by the clearance between the smaller-diameter portion 7*a* of the command piston 7 and the wall of the cylinder 3*a*. A feature of the second preferred embodiment over the first preferred embodiment resides in that the smaller-diameter portion 7*a* of the command piston 7 is formed with a lateral or transverse through hole 7*d*, a movable range of which is within the increased-diameter portion 3*b* of the cylinder 3*a*, and a small-diameter hole 27*b* extending from the upper end surface 7*c* to reach the lateral through hole 7*d*. The lateral through hole 7*d* and the small-diameter hole 27*b* cooperatively form the second flow restrictor 27 in the second preferred embodiment. As appreciated, the small-diameter hole 27*b* provides the major flow restricting effect, while the lateral through hole 7*d* works in an auxiliary fashion. As further appreciated, the cross-shaped grooves 27*a* in the first preferred embodiment are not provided in the second preferred embodiment.

Now, an operation of the second preferred embodiment will be described hereinbelow.

Figure 7:
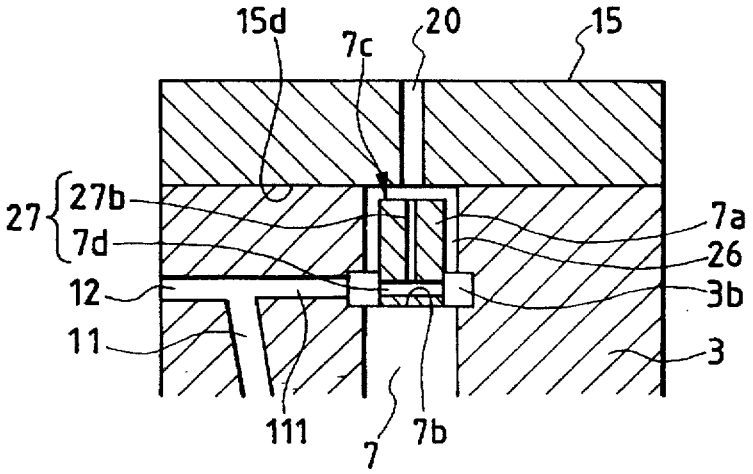
FIG. 7 is an enlarged sectional view of a main portion of a fuel injection valve of an accumulator fuel injection device for an internal combustion engine according to a second preferred embodiment of the present invention, wherein fuel injection is not performed.

In the state shown in FIG. 7 where the fuel injection is stopped, the high-pressure fuel fed from the inlet port 12 is divided so as to flow, in parallel, through the first flow restrictor 26 having a relatively large flow-passage sectional area and the second flow restrictor 27 having the small-diameter hole 27*b* with a small flow-passage sectional area. Since the first and second flow restrictors 26 and 27 are arranged in parallel, the total flow rate becomes greater than that achieved in the state of FIG. 2 which corresponds to FIG. 7.

Figure 8:
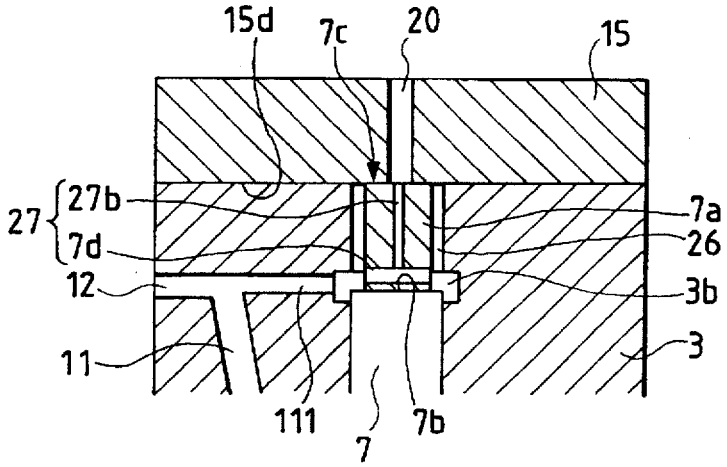
FIG. 8 is an enlarged sectional view of the main portion shown in FIG. 7, wherein fuel injection is performed.

On the other hand, in the state shown in FIG. 8 where the fuel injection is performed, the command piston 7 is raised to cause its upper end surface 7*c* to abut the lower end surface 15*d* so that the flow passage of the first flow restrictor 26 is blocked or closed. As a result, the high-pressure fuel can be introduced into the control port 20 only through the second flow restrictor 27. Thus, as in the state of FIG. 4 in the first preferred embodiment, the wasteful release of the high-pressure fuel in the accumulator piping 23 toward the fuel tank 14 during the fuel injection is effectively prevented. As compared with the first preferred embodiment, the first and second flow restrictors 26 and 27 are arranged in series to each other in the first preferred embodiment while arranged in parallel with each other in the second preferred embodiment. On the other hand, the similar effects can be achieved in the first and second preferred embodiments as appreciated from the foregoing description.

Figure 9:
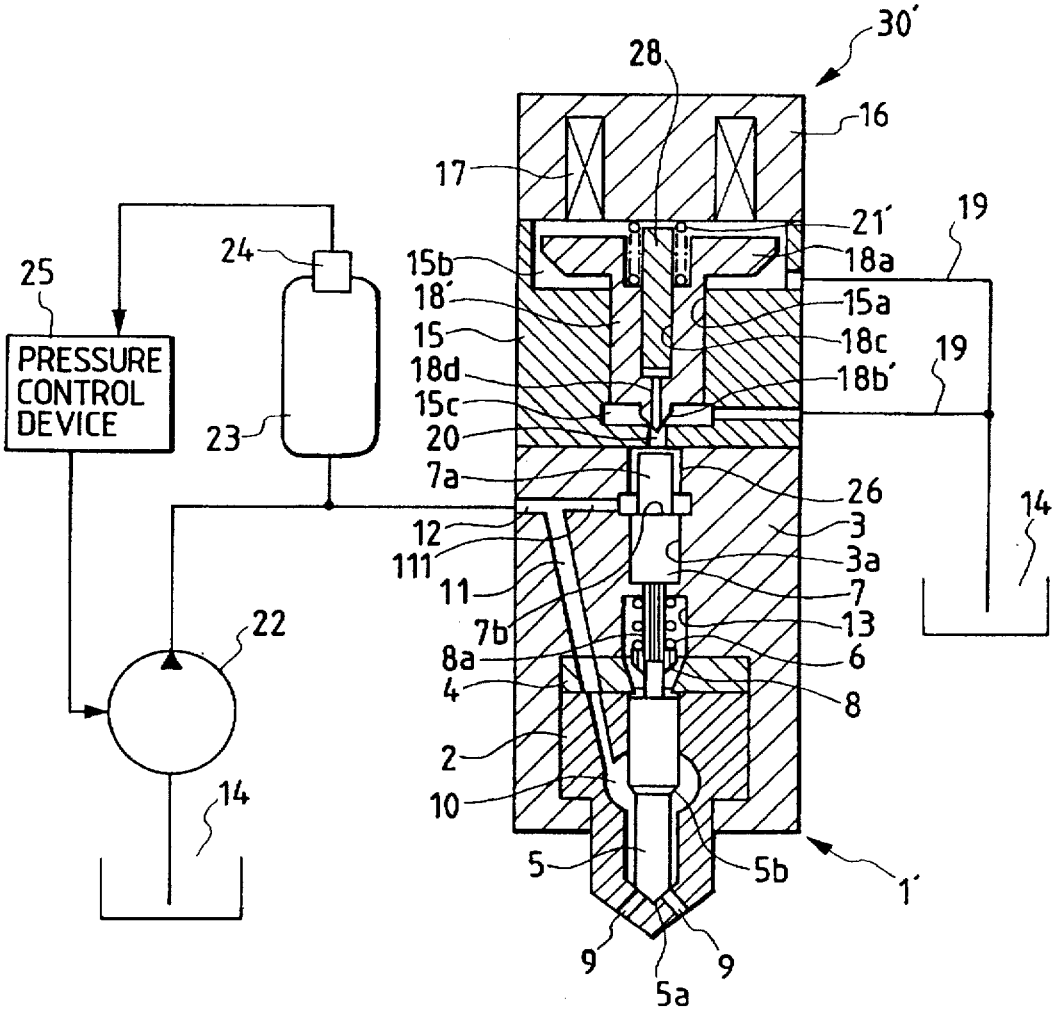
FIG. 9 is a sectional view showing the whole structure of an accumulator fuel injection device for an internal combustion engine according to a third preferred embodiment of the present invention.

Now, the third preferred embodiment of the present invention will be described hereinbelow with reference to FIG. 9. In FIG. 9, a reference sign with a comma represents a component which corresponds to the component assigned the same reference sign without a comma in the first preferred embodiment while slightly differs therefrom.

The third preferred embodiment differs from the first preferred embodiment in a structure of a solenoid valve 30' as compared with the solenoid valve 30. Specifically, a valve element 18' of the solenoid valve 80+ is formed therein with a small cylinder 18*c* and further with a communication hole 18*d* extending from the lower end of the cylinder 18*c* to the tip of a valve needle 18*b*' so as to open toward the control port 20. Further, a balance rod 28 is slidably received in the cylinder 18*c* with a clearance of about 2 to 3 μm relative to the wall of the cylinder 18*c*. The balance rod 28 is supported at its upper end by the lower end surface of the solenoid portion 16. A biasing force of a valve spring 21' may be set smaller than that of the valve spring 21.

With the foregoing arrangement, in the state shown in FIG. 9, the fuel pressure in the control port 20 is introduced into the cylinder 18*c* via the communication hole 18*d* so as to press the balance rod 28 upward. Thus, the valve element 18' is biased downward due to the reaction thereof. This biasing force is exerted in the same direction as the biasing force of the valve spring 21' so that the biasing force of the valve spring 21' can be reduced by a value corresponding to the reactive biasing force. Accordingly, the attraction force produced at the solenoid portion 16 for attracting upward the disk portion 18*a* against the biasing force of the valve spring 21' can also be reduced. As a result, the solenoid valve 30' in the third preferred embodiment can be reduced in size as compared with the solenoid valve 30 in the first preferred embodiment.

Now, the fourth preferred embodiment of the present invention will be described hereinbelow with reference to FIGS. 10 to 12.

The fourth preferred embodiment differs from the first preferred embodiment on the following points:

In the first preferred embodiment, the needle 5 is slidably received in the nozzle 2 with the clearance of about 2 to 3 μm between the larger-diameter portion 51 and the inner wall of the nozzle 2. On the other hand, in the fourth preferred embodiment, the clearance between the larger-diameter portion 51 and the inner wall of the nozzle 2 is set to be somewhat greater than 2 to 3 μm so that this clearance works as a first flow restrictor 26'. Further, in the fourth preferred embodiment, as shown in FIG. 1, the control port 20 extends from the drain chamber 15*c* to the spring chamber 13, with a uniform diameter over the length thereof. Thus, as further shown in FIG. 1, the cylinder 3*a* along with the command piston 7 and further the high-pressure fuel passage 111 branching from the high-pressure fuel passage 11 are not provided. The extended control port 20 works as a back-pressure chamber for the needle 5. In the first preferred embodiment, the spring chamber 13 constantly communicates with the drain side, that is, the fuel tank 14, via the passage (not shown). On the other hand, in the fourth preferred embodiment, the spring chamber 13 can only communicate with the drain side via the drain pipe 19 when the valve element 18 with the valve needle 18*b* opens the control port 20.

Before describing further differences over the first preferred embodiment, an operation of a fuel injection valve 1' according to the fourth preferred embodiment will be briefly described.

Figure 10:
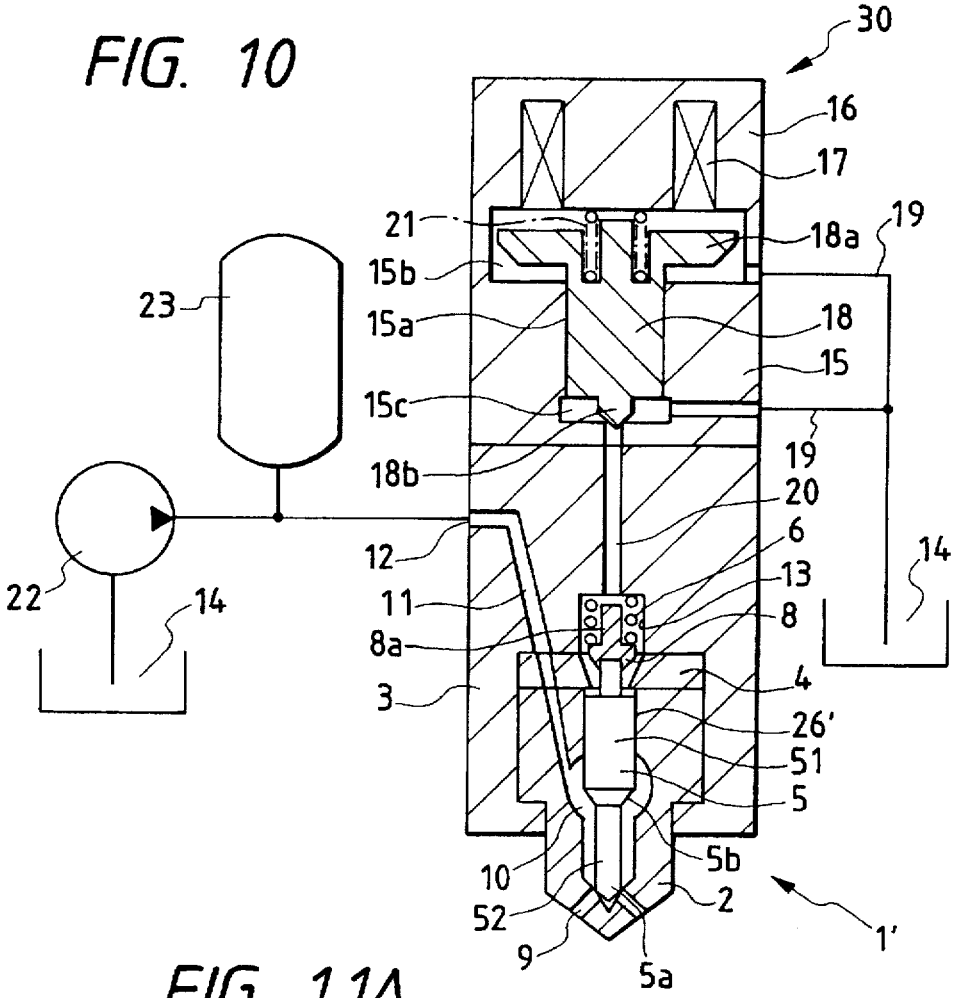
FIG. 10 is a sectional view showing the whole structure of an accumulator fuel injection device for an internal combustion engine according to a fourth preferred embodiment of the present invention.

In the state shown in FIG. 10, the solenoid coil 17 is deenergized so that the fuel injection is not performed. The high-pressure fuel in the accumulator piping 23 is introduced to the neighborhood of the fuel injection holes 9 via the inlet port 12, the high-pressure fuel passage 11, the off sump 10 and the annular passage around the smaller-diameter portion 52 of the needle 5. Simultaneously, the high-pressure fuel is also introduced into the back-pressure chamber 20 for the needle 5 via the inlet port 12, the high-pressure fuel passage 11, the oil sump 10 and the first flow restrictor 26'. In this state, the needle 5 is pressed downward by means of the high fuel pressure applied to the back-pressure chamber 20 and the biasing force of the needle spring 6, so as to close the fuel injection holes 9.

On the other hand, when the solenoid coil 17 is energized by the drive circuit (not shown), the valve element 18 is attracted upward against the biasing force of the spring 21 so that the valve needle 18*b* opens the back-pressure chamber 20. Thus, the back-pressure chamber 20 communicates with the fuel tank 14 so that the pressure in the back-pressure chamber 20 is reduced. Then, the needle 5 moves upward due to the high fuel pressure accumulated in the oil sump 10 so as to open the fuel injection holes 9. Thus, the fuel injection is started via the fuel injection holes 9.

When the solenoid coil 17 is deenergized so as to stop the fuel injection, since the magnetic attraction force is released, the valve element 18 moves downward to close the back-pressure chamber 20 relative to the drain chamber 15*c* and thus the fuel tank 14. Thus, the pressure in the back-pressure chamber 20 increases due to the high-pressure fuel introduced from the oil sump 10 via the first flow restrictor 26'. Then, the needle 5 starts to move downward to close the fuel injection holes 9 so that the fuel injection is stopped.

Now, referring to FIGS. 11A and 11B, further differences over the first preferred embodiment will be described hereinbelow.

Figure 11A:
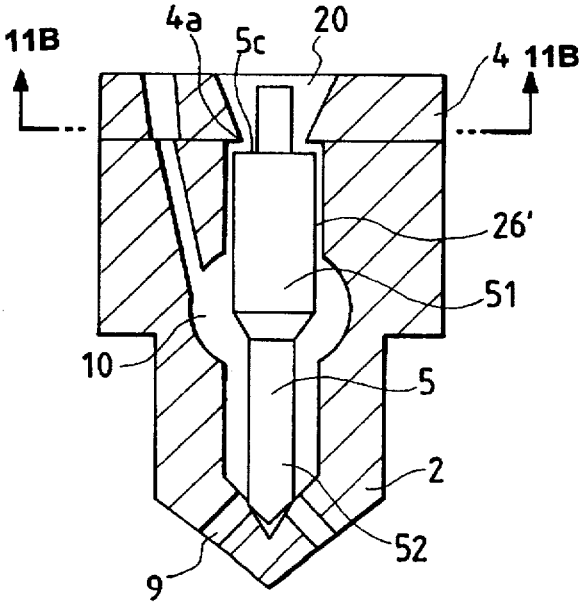
FIG. 11A is an enlarged sectional view of a main portion of a fuel injection valve shown in FIG. 10, wherein fuel injection is not performed.
Figure 11B:
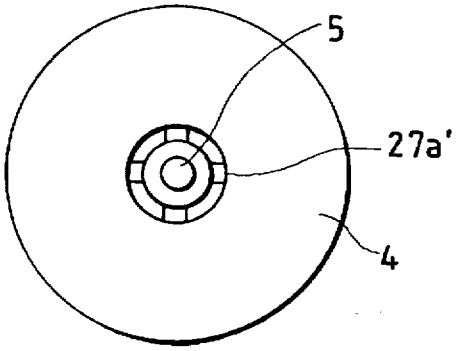
FIG. 11B is a sectional view taken along line B—B in FIG. 11A.

As shown in FIGS. 11A and 11B, in this preferred embodiment, a plurality of grooves 27*a'* corresponding to the cross-shaped grooves 27*a* are formed on a lower end surface 4*a* of the distance piece 4 confronting an upper end surface 5*c* of the larger-diameter portion 51 of the needle 5. In the state shown in FIG. 11A where the fuel injection is stopped, the upper end surface 5*c* of the needle 5 is separated from the lower end surface 4*a* of the distance piece so that the oil sump 10 communicates with the back-pressure chamber 20 via the first flow restrictor 26'. On the other hand, when the pressure in the back-pressure chamber 20 is reduced so that the needle 5 is fully lifted to its uppermost position, the upper end surface 5*c* of the needle 5 abuts the lower end surface 4*a* of the distance piece 4 so that the oil sump 10 communicates with the back-pressure chamber 20 via the first flow restrictor 26' and a second flow restrictor formed between the grooves 27*a'* on the lower end surface 4*a* of the distance piece 4 and the upper end surface 5*c* of the needle 5. In this preferred embodiment, a flow restricting resistance of the second flow restrictor is set equal to or greater than that of the first flow restrictor 26'. With this arrangement, the wasteful release of the high-pressure fuel can be prevented during the fuel injection, that is, when the needle 5 is fully lifted to its uppermost position, as in the foregoing first preferred embodiment.

Now, an operation of the fourth preferred embodiment will be described hereinbelow with reference to FIG. 12. FIG. 12 is a time chart showing a relationship between a lift amount (needle lift) of the needle 5 and a flow rate of the fuel from the oil sump 10 to the back-pressure chamber 20.

While the needle 5 is lifted (after $T_0$ to $T_1$), the high-pressure fuel in the oil sump 10 flows out into the back-pressure chamber 20 via the first flow restrictor 26', that is, only subjected to the flow restricting resistance of the first flow restrictor 26'. Subsequently, while the needle 5 is fully lifted ($T_1$ to $T_2$), the high-pressure fuel in the oil sump 10 flows out into the back-pressure chamber 20 via the first flow restrictor 26' and the second flow restrictor (grooves 27*a'*). Thus, as shown by the solid line in FIG. 12, the flow rate of the fuel is suppressed during the fuel injection. On the other hand, while the needle 5 is lowered ($T_2$ to $T_3$), since the formation of the second flow restrictor is released, the high-pressure fuel in the oil sump 10 flows out into the back-pressure chamber 20 via the first flow restrictor 26'.

Figure 12:
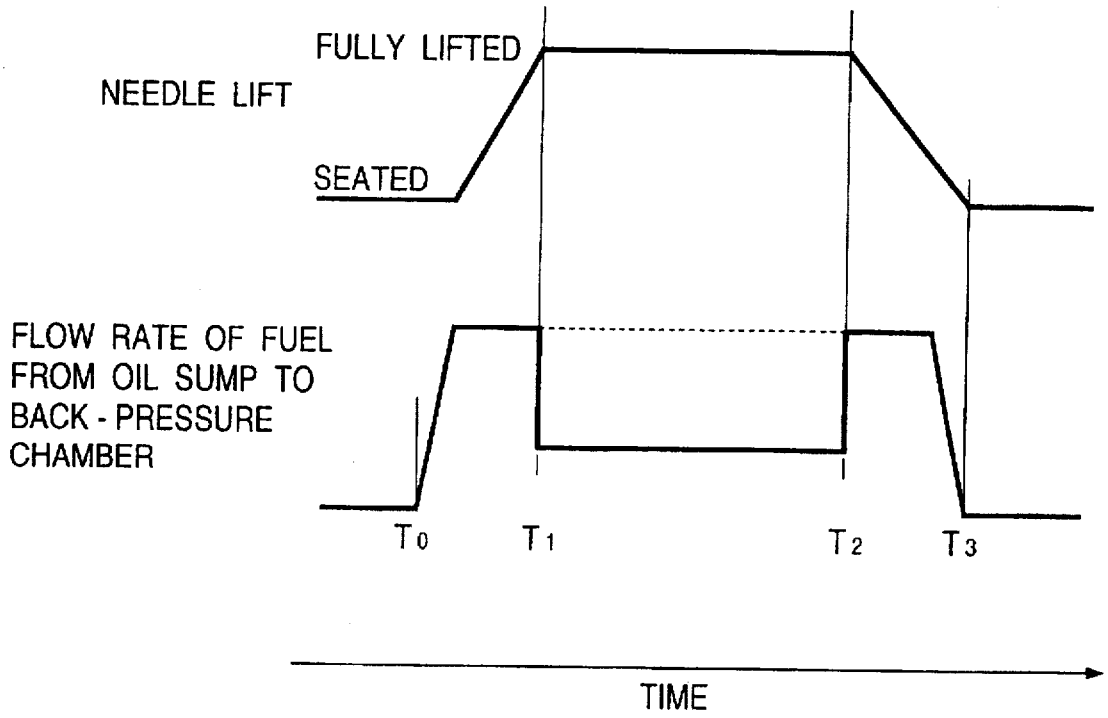
FIG. 12 is a time chart showing a relationship between a lift amount (needle lift) of a needle and a flow rate of fuel from an oil sump to a back-pressure chamber according to the fourth preferred embodiment.

If the second flow restrictor is not formed as in the foregoing conventional fuel injection device having only the fixed orifice, the fuel flow rate from $T_1$ to $T_2$ (fully lifted) becomes as shown by the dotted line in FIG. 12 so that a large amount of the high-pressure fuel is released into the drain side via the back-pressure chamber 20 with a lapse of time.

As appreciated from the foregoing description, in this preferred embodiment, as in the forgoing first preferred embodiment, since the second flow restrictor is established while the needle 5 is fully lifted, the flow rate of the fuel during the fuel injection can be suppressed. Further, since the second flow restrictor is released when the needle 5 is lowered even slightly, the quick response for stopping the fuel injection is also ensured.

Now, the fifth preferred embodiment of the present invention will be described hereinbelow with reference to FIGS. 13A and 13B.

Figure 13A:
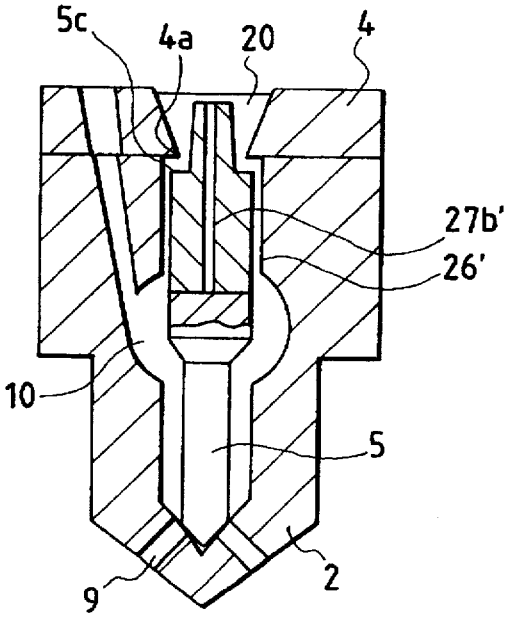
FIG. 13A is an enlarged sectional view of a main portion of a fuel injection valve of an accumulator fuel injection device for an internal combustion engine according to a fifth preferred embodiment of the present invention, wherein fuel injection is not performed.
Figure 13B:
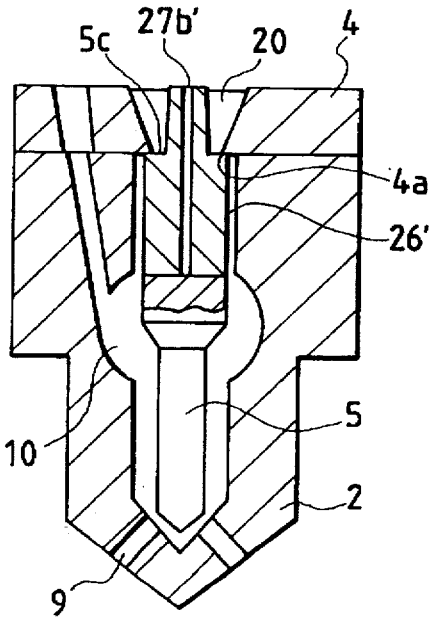
FIG. 13B is an enlarged sectional view of the main portion shown in FIG. 13A, wherein fuel injection is performed.
Figure 14:
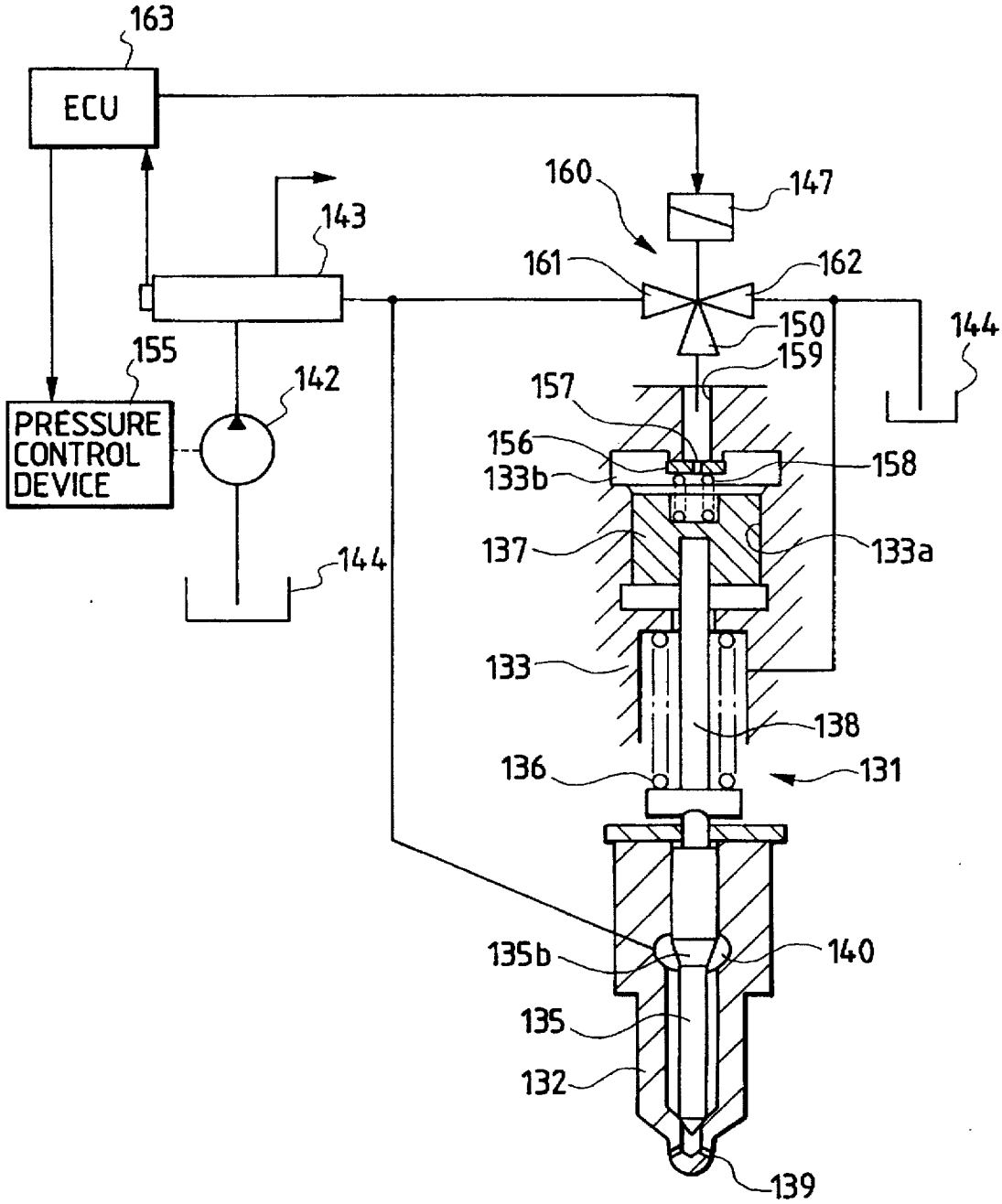
FIG. 14 PRIOR ART
FIG. 14 is a sectional view showing the whole structure of a conventional accumulator fuel injection device for an internal combustion engine.
Figure 15:
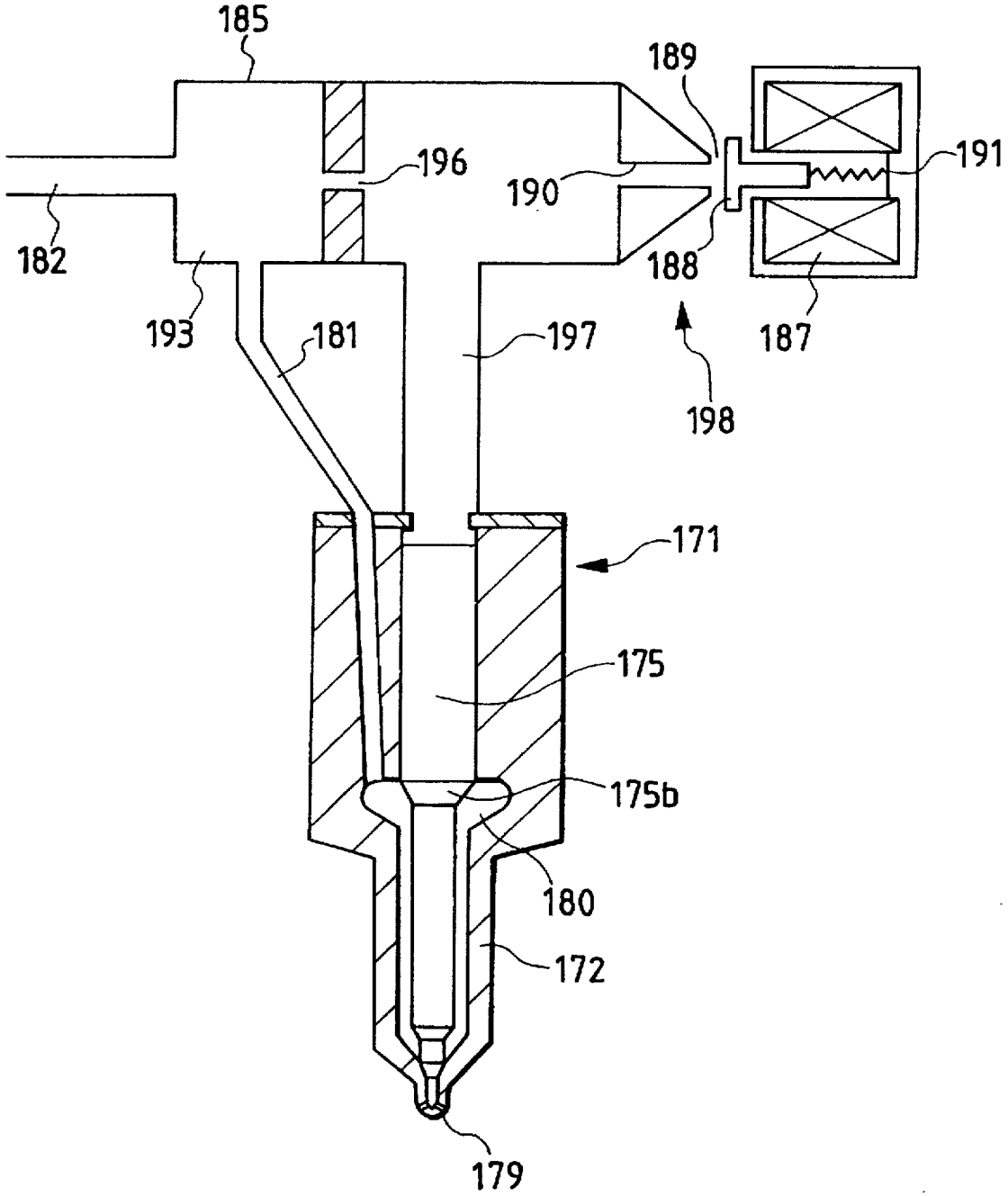
FIG. 15 PRIOR ART
FIG. 15 is a sectional view showing a conventional accumulator fuel injection device for an internal combustion engine, using a two-way valve.

In the state shown in FIG. 13A where the fuel injection is not performed, the upper end surface 5*c* of the needle 5 is separated from the lower end surface 4*a* of the distance piece 4 so that the off sump 10 communicates with the back-pressure chamber 20 via the first flow restrictor 26' and via a second flow restrictor in the form of a small-diameter fuel passage formed in the needle 5. Although not shown in FIGS. 13A and 13B, a lateral through hole corresponding to the lateral through hole 7*d* shown in FIGS. 7 and 8 is also formed in the needle 5. On the other hand, in the state shown in FIG. 13B where the fuel injection is performed, that is, when the needle 5 is fully lifted, the upper end surface 5*c* of the needle 5 abuts the lower end surface 4*a* of the distance piece 4 so that the flow passage of the first flow restrictor 26' is blocked or closed. Thus, the oil sump 10 communicates with the back-pressure chamber 20 only through the second flow restrictor so that the flow rate of the high-pressure fuel from the oil sump 10 to the back-pressure chamber 20 can be suppressed. Accordingly, the wasteful release of the high-pressure fuel toward the drain side can be effectively prevented during the fuel injection also in this preferred embodiment.

As appreciated, in the fourth and fifth preferred embodiments, the foregoing non-injecting operation can also be effectively achieved as in the foregoing first to third preferred embodiments. Further, by providing the pressure sensor 24 and the pump pressure control device 25, the control of the pressure in the accumulator piping 23 can also be achieved as in the forgoing first to third preferred embodiments.

Although the foregoing preferred embodiments each relate to the fuel injection device of an accumulator type, the present invention is also applicable to a fuel injection device of a non-accumulator type. As appreciated, even in this case, the wasteful release of the high-pressure fuel to the drain side during the fuel injection can be effectively prevented while ensuring a quick response for stopping the fuel injection.

While the present invention has been described in terms of the preferred embodiments, the invention is not to be limited thereto, but can be embodied in various ways without departing from the principle of the invention as defined in the appended claims.

What is claimed is:

1. A fuel injection device comprising:

a needle movable between a first position for injecting fuel and a second position for blocking injection of fuel;

a back-pressure chamber for receiving high-pressure fuel, said back-pressure chamber being positioned such that pressure from the high-pressure fuel within said back-pressure chamber is applied to an upper end side of said needle for urging said needle toward the second position;

a two-way valve for opening and closing a flow passage between said back-pressure chamber and a drain side to release high-pressure fuel from said back-pressure chamber and to change pressure within said back-pressure chamber so as to move the needle between said first and second positions for controlling injection of the fuel; and flow restricting means, provided in a flow passage for introducing the high-pressure fuel into said back-pressure chamber, for restricting a flow of the high-pressure fuel passing through the flow passage based on a position of said needle, said flow restricting means reducing a flow-passage area of the flow passage when said needle moves to said first position.

2. The fuel injection device according to claim 1, further comprising:

an accumulator piping for storing the high-pressure fuel, a high-pressure pump for pressurizing fuel to be the high-pressure fuel fed to said accumulator piping, and a pump pressure control device for regulating a pressure of the fuel in said accumulator piping by controlling said high-pressure pump.

3. The fuel injection device according to claim 1, further comprising:

an oil sump formed around a stepped portion of said needle for receiving the high-pressure fuel and for urging said needle toward said first position based on pressure of the high-pressure fuel, and a needle spring for biasing said needle toward the second position.

4. The fuel injection device according to claim 1, wherein said flow restricting means comprises a first flow restrictor and a second flow restrictor which are arranged in series with each other.

5. The fuel injection device according to claim 4, further comprising a command piston coupled to the upper end side of said needle, wherein the pressure in said back-pressure chamber is applied to said command piston.

6. The fuel injection device according to claim 5, wherein said first flow restrictor is formed around an upper portion of said command piston.

7. The fuel injection device according to claim 6, wherein said second flow restrictor comprises a groove formed on an upper end surface of said command piston and a surface confronting said upper end surface of said command piston, the groove restricting a flow of the high-pressure fuel passing between the groove and the confronting surface when said needle moves to the first position and the upper end surface of said command piston abuts the confronting surface.

8. The fuel injection device according to claim 6, wherein said second flow restrictor comprises a groove formed on a surface confronting an upper end surface of said command piston and said upper end surface of the command piston, the groove restricting a flow of the high-pressure fuel passing between the groove and the upper end surface of said command piston when said needle moves to the first position and the upper end surface of said command piston abuts the confronting surface.

9. The fuel injection device according to claim 1, wherein said flow restricting means comprises a first flow restrictor and a second flow restrictor which are arranged in parallel with each other.

10. The fuel injection device according to claim 9, further comprising a command piston coupled to the upper end side of said needle wherein the pressure in said back-pressure chamber is applied to said command piston.

11. The fuel injection device according to claim 10, wherein said first flow restrictor is formed by a flow passage surrounding an upper portion of said command piston.

12. The fuel injection device according claim 11, wherein said second flow restrictor comprises a through hole formed in said command piston, the flow passage forming said first flow restrictor being blocked when said needle moves to said first position and said command piston abuts a surface confronting said command piston.

13. The fuel injection device according to claim 1, wherein said two-way valve comprises a valve element formed therein with a cylinder communicating with said back-pressure chamber, a balance rod being inserted into said cylinder to urge the valve element toward said back-pressure chamber based on a reaction force generated when the pressure in said back-pressure chamber is applied to the balance rod via said cylinder.

14. The fuel injection device according to claim 4, further comprising a nozzle in which said needle is movably received, wherein said first flow restrictor is formed between an upper portion of said needle and an inner wall of said nozzle.

15. The fuel injection device according to claim 14, further comprising a distance piece mounted at an upper end of said nozzle, wherein said second flow restrictor comprises a groove formed on a lower end surface of said distance piece and an upper surface of said needle, the groove restricting a flow of the high-pressure fuel passing between the groove and the upper surface of said needle when said needle moves to the first position and the upper surface of said needle abuts the lower end surface of said distance piece.

16. The fuel injection device according to claim 9, further comprising a nozzle in which said needle is movably received, wherein said first flow restrictor is formed by a flow passage between an upper portion of said needle and an inner wall of said nozzle.

17. The fuel injection device according to claim 16, further comprising a distance piece mounted at an upper end of said nozzle, wherein said second flow restrictor comprises a through hole formed in said needle, and wherein said flow passage forming said first flow restrictor is blocked when said needle moves to said first position to abut a lower end surface of said distance piece mounted at an upper end of said nozzle.

18. The fuel injection device according to claim 1, wherein said two-way valve is a solenoid valve.

19. A fuel injection device comprising:

a fuel inlet port for supplying fuel;

a needle movable between a first position for injecting the fuel and a second position for blocking injection of the fuel;

a back-pressure chamber communicating with said fuel inlet port, said back-pressure chamber maintaining communication with at least a portion of the fuel and applying an inner pressure from the fuel to an upper end side of said needle for urging said needle toward said second position;

a first fuel passage connecting said fuel inlet port with said back-pressure chamber for introducing said portion of said fuel to said back-pressure chamber;

a second fuel passage disposed independently of said first fuel passage, said second fuel passage providing communication between said back-pressure chamber and a drain side;

a two-way valve disposed in said second fuel passage to open and close said second fuel passage causing the inner pressure to change so as to move said needle between said first and second positions for controlling injection of the fuel, said two-way valve normally closing said second fuel passage to hold said needle to the second position so that the fuel injection is responsive to opening of said second fuel passage by said two-way valve; and a flow restrictor disposed in said first fuel passage for restricting a flow-passage area of said first fuel passage based on a position of said needle, said flow passage area being restricted when said needle reaches the first position.

20. The fuel injection device according to claim 19, further comprising:

an accumulator piping for storing the fuel, a high-pressure pump for pressuring the fuel being fed to said accumulator piping, and a pump pressure control device is provided for regulating a pressure of the fuel in said accumulator piping by controlling said high-pressure pump.

21. The fuel injection device according to claim 19, further comprising:

an oil sump formed around a stepped portion of said needle for receiving the fuel and for urging said needle toward said first position based on pressure of the fuel, and a needle spring for biasing said needle toward the second position.

22. The fuel injection device according to claim 19, wherein said flow restricting means comprises a first flow restrictor and a second flow restrictor which are arranged in series with each other.

23. The fuel injection device according to claim 22, further comprising a command piston coupled to the upper end side of said needle, wherein the inner pressure in said back-pressure chamber is applied to said command piston.

24. The fuel injection device according to claim 23, wherein said first flow restrictor is formed around an upper portion of said command piston.

25. The fuel injection device according to claim 24, wherein said second flow restrictor comprises a groove formed on an upper end surface of said command piston and a surface confronting said upper end surface of the command piston, the groove restricting a flow of the fuel passing between the groove and the confronting surface when said needle moves to the first position and the upper end surface of the command piston abuts the confronting surface.

26. The fuel injection device according to claim wherein said second flow restrictor comprises a groove formed on a surface confronting an upper end surface of said command piston and said upper end surface of the command piston, the groove restricting a flow of the fuel passing between the groove and the upper end surface of the command piston when said needle moves to the first position and the upper end surface of the command piston abuts the confronting surface.

27. The fuel injection device according to claim 19, wherein said flow restricting means comprises a first flow restrictor and a second flow restrictor which are arranged in parallel with each other.

28. The fuel injection according to claim 27, further comprising a command piston coupled to the upper end side of said needle, wherein the inner pressure in said back-pressure chamber is applied to a command piston.

29. The fuel injection device according to claim 28, wherein said first flow restrictor is formed by a flow passage surrounding an upper portion of said command piston.

30. The fuel injection device according to claim 29, wherein said second flow restrictor comprises a through hole formed in said command piston, the flow passage forming said first flow restrictor being blocked when said needle moves to said first position and said command piston abuts a surface confronting said command piston.

31. The fuel injection device according to claim 19, wherein said two-way valve comprises a valve element formed therein with a cylinder communicating with said back-pressure chamber, a balance rod being inserted into said cylinder to urge the valve element toward said back-pressure chamber based on a reaction force generated when the inner pressure in said back-pressure chamber is applied to the balance rod via said cylinder.

32. The fuel injection device according to claim 22, further comprising a nozzle in which said needle is movably received, wherein said first flow restrictor is formed between an upper portion of said needle and an inner wall of said nozzle.

33. The fuel injection device according to claim 32, further comprising a distance piece mounted at an upper end of said nozzle, wherein said second flow restrictor comprises a groove formed on a lower end surface of said distance piece and an upper surface of said needle, the groove restricting a flow of the fuel passing between the groove and the upper surface of the needle when said needle moves to the first position and the upper surface of said needle abuts the lower end surface of said distance piece.

34. The fuel injection device according to claim 27, further comprising a nozzle in which said needle is movably received, wherein said first flow restrictor is formed by a flow passage between an upper portion of said needle and an inner wall of said nozzle.

35. The fuel injection device according to claim 34, further comprising a distance piece mounted at an upper end of said nozzle wherein said second flow restrictor comprises a through hole formed in said needle, and wherein said flow passage forming said first flow restrictor is blocked when said needle moves to said first position to abut a lower end surface of said distance piece.

36. The fuel injection device according to claim 19, wherein said two-way valve is a solenoid valve.

* * * * *